US010132585B2

(12) United States Patent
Harper et al.

(10) Patent No.: US 10,132,585 B2
(45) Date of Patent: Nov. 20, 2018

(54) TRIGGER GUARD SAFETY DEVICE FOR A WEAPON

(71) Applicant: TriggerSafe LLC, Indianapolis, IN (US)

(72) Inventors: Vincent Dewayne Harper, Indianapolis, IN (US); James Joseph Gray, Indianapolis, IN (US)

(73) Assignee: Triggersafe LLC, Indianapolis, IN (US)

( * ) Notice: Subject to any disclaimer, the term of this patent is extended or adjusted under 35 U.S.C. 154(b) by 0 days.

(21) Appl. No.: 15/402,054

(22) Filed: Jan. 9, 2017

(65) Prior Publication Data

US 2017/0227316 A1 Aug. 10, 2017

Related U.S. Application Data

(60) Provisional application No. 62/276,427, filed on Jan. 8, 2016.

(51) Int. Cl.
*F41A 17/54* (2006.01)

(52) U.S. Cl.
CPC ..... *F41A 17/54* (2013.01)

(58) Field of Classification Search
CPC ..... F41A 17/54; F41C 33/0245
USPC ..... 42/70.07; 224/244
See application file for complete search history.

(56) References Cited

U.S. PATENT DOCUMENTS 2,893,152 A * 7/1959 Peluso ..... F41A 17/54 42/70.06
3,022,596 A * 2/1962 Cannon ..... F41A 17/54 42/70.06
3,616,559 A * 11/1971 Sobolewski ..... F41A 17/02 42/70.06
4,509,281 A * 4/1985 Dreiling ..... F41A 17/54 42/70.07
4,916,842 A * 4/1990 Hardy ..... F41A 17/54 42/70.07
5,054,222 A * 10/1991 Hardy ..... F41A 17/54 42/70.07
5,283,971 A * 2/1994 Fuller ..... F41A 17/04 42/70.06
6,398,089 B1 * 6/2002 Har-Shen ..... F41C 33/0209 224/192
7,258,259 B1 * 8/2007 Owens ..... A45F 5/02 224/192
9,322,605 B1 * 4/2016 Noyons ..... F41A 17/54
2005/0205624 A1 * 9/2005 French ..... F41C 33/0263 224/244
2008/0221580 A1 * 9/2008 Miller ..... A61B 10/025 606/80

(Continued)

*Primary Examiner* — Bret Hayes
(74) *Attorney, Agent, or Firm* — Ice Miller LLP

(57) ABSTRACT

A trigger guard safety device for movement of a trigger of a weapon is provided. The trigger guard safety device is unobtrusive and molded to fit around the trigger guard of a weapon such that the trigger guard safety device physically prevents access to and depression of the trigger. The trigger guard safety device is of unitary construction and comprises sides, bottom, and depressions formed in the sides. When secured in place, the trigger guard safety device provides for safe transportation of a loaded weapon while allowing quick discharge of the weapon when necessary.

4 Claims, 5 Drawing Sheets

(56) References Cited

U.S. PATENT DOCUMENTS

| | | | | |
|---|---|---|---|---|
| 2012/0286005 | A1* | 11/2012 | Farnlacher | F41C 33/0245<br>224/244 |
| 2013/0061502 | A1* | 3/2013 | Derman | F41A 17/54<br>42/70.07 |
| 2016/0341519 | A1* | 11/2016 | Gaiser | F41C 33/0245 |

* cited by examiner

TRIGGER GUARD SAFETY DEVICE FOR A WEAPON

CROSS-REFERENCE TO RELATED APPLICATIONS

The present application is a nonprovisional patent application, which claims priority to U.S. Provisional Patent Application Ser. No. 62/276,427, filed Jan. 8, 2016, and having the title "TRIGGER GUARD SAFETY DEVICE FOR A WEAPON," which is herein incorporated in its entirety.

TECHNICAL FIELD OF THE DISCLOSED EMBODIMENTS

The embodiments herein generally relate to a safety device for a weapon and, more particularly, to a trigger guard safety device for a gun.

BACKGROUND OF THE DISCLOSED EMBODIMENTS

Many weapons, including rifles, shotguns and handguns are equipped by their manufacturers with safety devices which mechanically lock the triggers thereof against actuation and firing of the weapon. These devices are generally effective, but many users may not notice that the safety device has been inactivated, thereby increasing the risk of an unintended discharge of the weapon.

Many different aftermarket safety devices are available to prevent inadvertent discharge of weapons, but these devices require disassembly of the safety device, or unlocking by a key or combination to enable the weapon to be fired. While such devices are useful for their intended purposes when used properly, these devices are not necessarily practical in applications requiring the ability to quickly discharge a weapon.

A weapon that is loaded and potentially holstered may need to be fired quickly if the situation arises. Therefore, an effective safety device would allow for safely transporting a loaded weapon such that the weapon may be quickly freed of the safety device for firing. Such device would also ideally be easily secured to the weapon to provide for protection from an unintended discharge of the loaded weapon.

Known methods and devices for preventing a weapon from discharging can be cumbersome if quick discharge is warranted. Therefore, a need exists to provide an easy to operate and unobtrusive safety device for preventing unintended discharge of a weapon. A need further remains for a safety device of simple construction particularly adapted for a gun such that the gun may be placed into a clothing waistband, holster or other storage location. This safety device would ideally be streamlined with minimal obstructions to impede drawing and discharging the weapon.

The presently disclosed embodiments are directed to meeting these needs.

SUMMARY OF THE DISCLOSED EMBODIMENTS

In one embodiment, a trigger guard safety device for securing the trigger of a weapon is provided. The trigger guard safety device is molded to conform to the particular trigger guard of a weapon. The trigger of the weapon is held in an undepressed state when the trigger guard safety device is secured in place. The trigger guard safety device prevents an unintended depression of the trigger while still allowing the slide to be cycled and the magazine released.

In one embodiment, the trigger guard safety device is made of a firm but semiflexible material such that the trigger guard safety device flexes when put in place on the trigger guard and snaps back to its original configuration when placed in the appropriate position on the trigger guard of a weapon. In another embodiment, the trigger guard safety device is formed from a plastic material that is moldable when heated and then hardens to a rigid but semiflexible material. In another embodiment the plastic material is Kydex® synthetic resinous material. It should be understood by one of skill in the art that other materials could be used to form the trigger guard safety device.

In one embodiment, the trigger guard safety device of unitary construction is comprised of a continuous u-shaped molded material such that the sides of the trigger guard include molded depressions that conform to the trigger guard of a particular weapon. It should be understood by one of skill in the art that the trigger guard safety device may be molded to fit several different kinds of weapons and trigger guards. This molded configuration allows for adequate security from an unintended discharge while the semiflexible material allows for quickly securing the trigger of a weapon or quickly releasing the trigger guard safety device.

In one embodiment, a secured trigger guard safety device may be removed by hand. In another embodiment, the trigger guard safety device may be removed by pulling off the trigger guard safety device with one hand. The streamlined configuration and semiflexible nature of the trigger guard safety device is such that it may be easily removed from its storage location and quickly removed with one hand for rapid discharge.

In one embodiment, the trigger guard safety device comprises flanges at the end of each side of the u-shaped trigger guard safety device such that when the trigger guard safety device is secured in place the flanges extend from the weapon from substantially 30 degrees to substantially 90 degrees and are disposed above the trigger and trigger guard of the weapon. These flanges aid in removal of the trigger guard safety device.

In another embodiment, the trigger guard safety device includes at least one hole at or near the bottom of the trigger guard safety device. In one embodiment, the at least one hole is located in the bottom of the trigger guard safety device at the end facing the forward end of the weapon. In one embodiment, a lanyard is strung through the at least one hole in the trigger guard safety device and secured to a separate object such that when the weapon is removed from its storage location the trigger guard safety device is removed by the action of the lanyard. In one embodiment, the at least one hole is placed in the molded trigger guard safety device without any additional obstruction that impedes drawing the weapon.

Other embodiments are also disclosed.

BRIEF DESCRIPTION OF DRAWINGS

The embodiments described herein and other features, advantages and disclosures contained herein, and the manner of attaining them, will become apparent and the present disclosure will be better understood by reference to the following description of various exemplary embodiments of the present disclosure taken in conjunction with the accompanying drawing, wherein.

DETAILED DESCRIPTION OF THE DISCLOSED EMBODIMENTS

Figure 1:
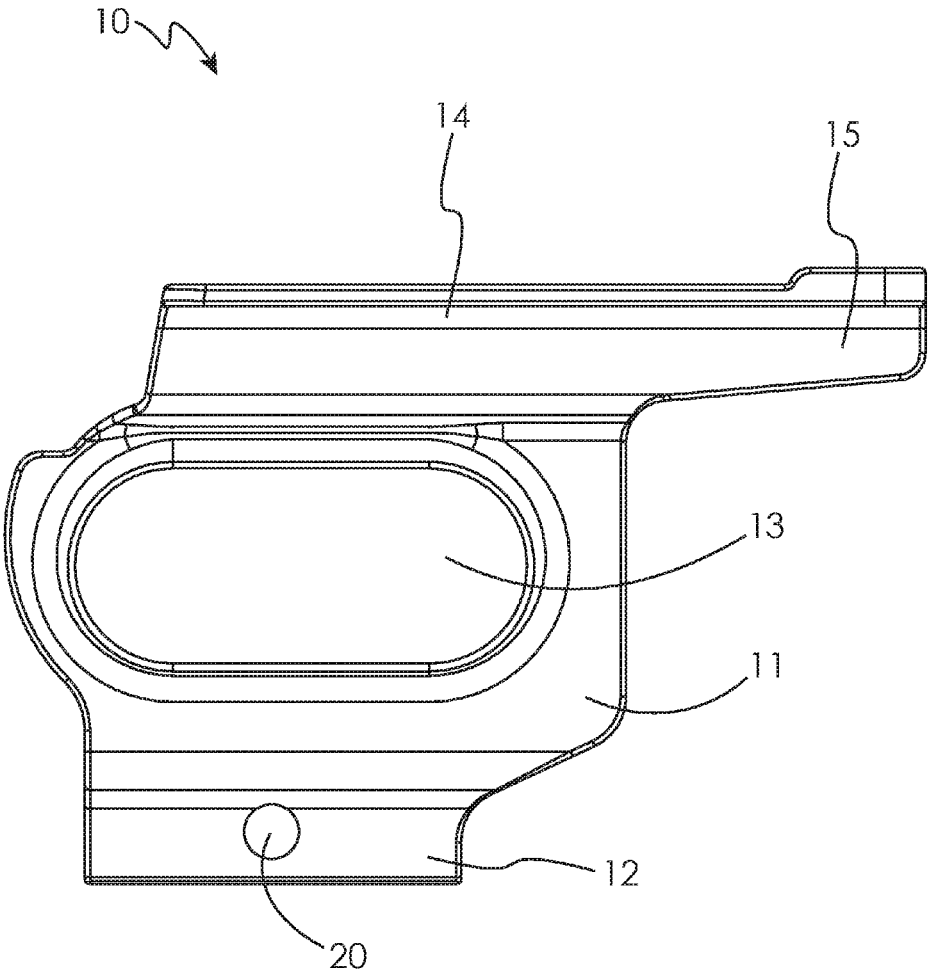
FIG. 1 is a side perspective view of a trigger guard safety device in accordance with an embodiment.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Figure 2:
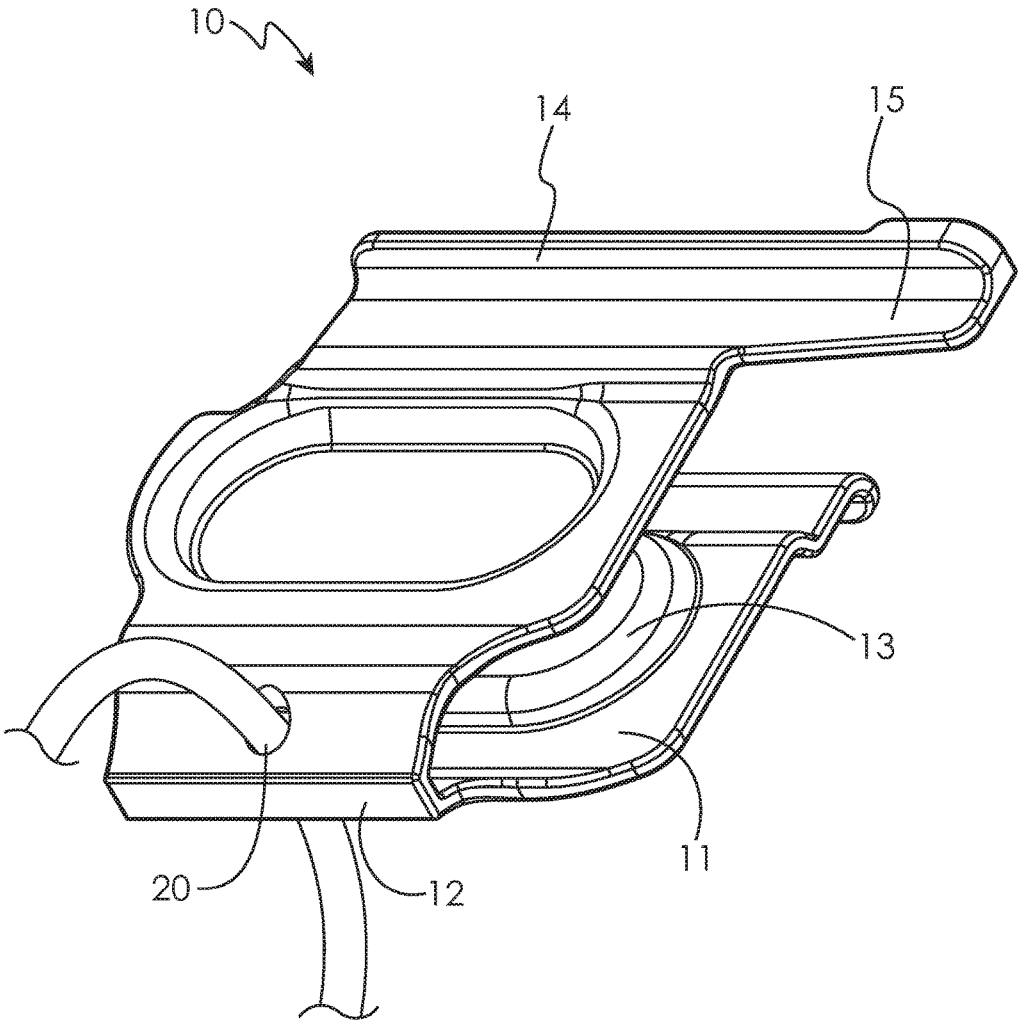
FIG. 2 is a bottom-side perspective view of a trigger guard safety device in accordance with an embodiment.
Figure 3:
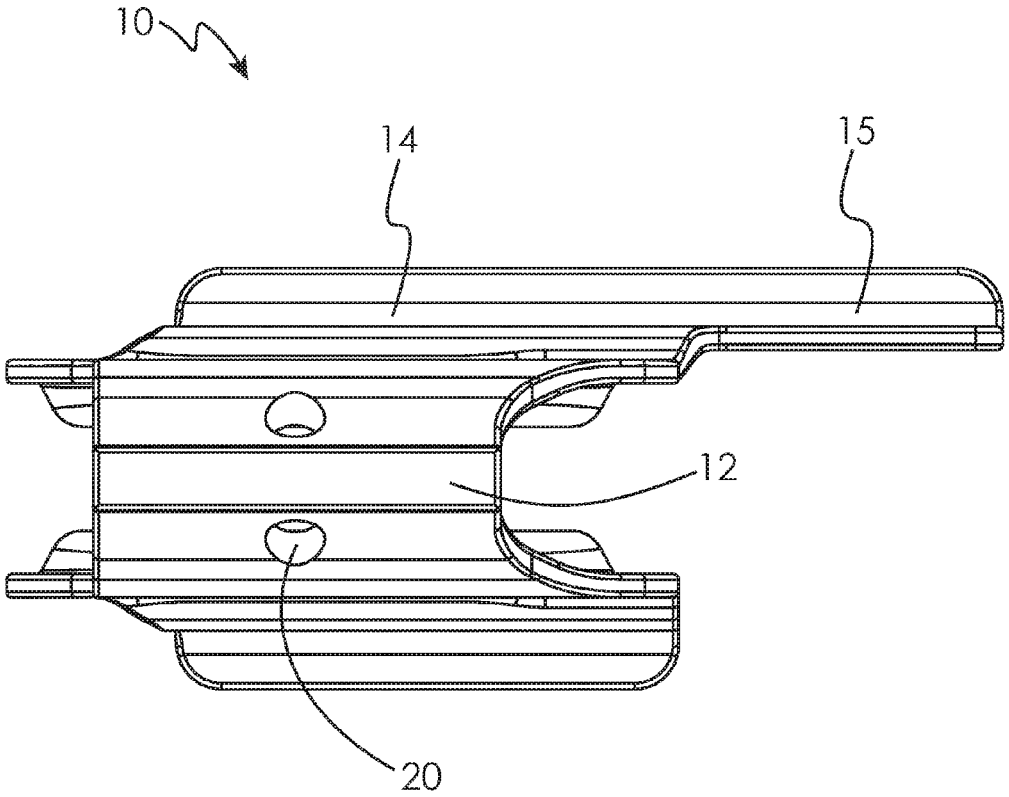
FIG. 3 is a bottom perspective view of a trigger guard safety device in accordance with an embodiment.
Figure 4:
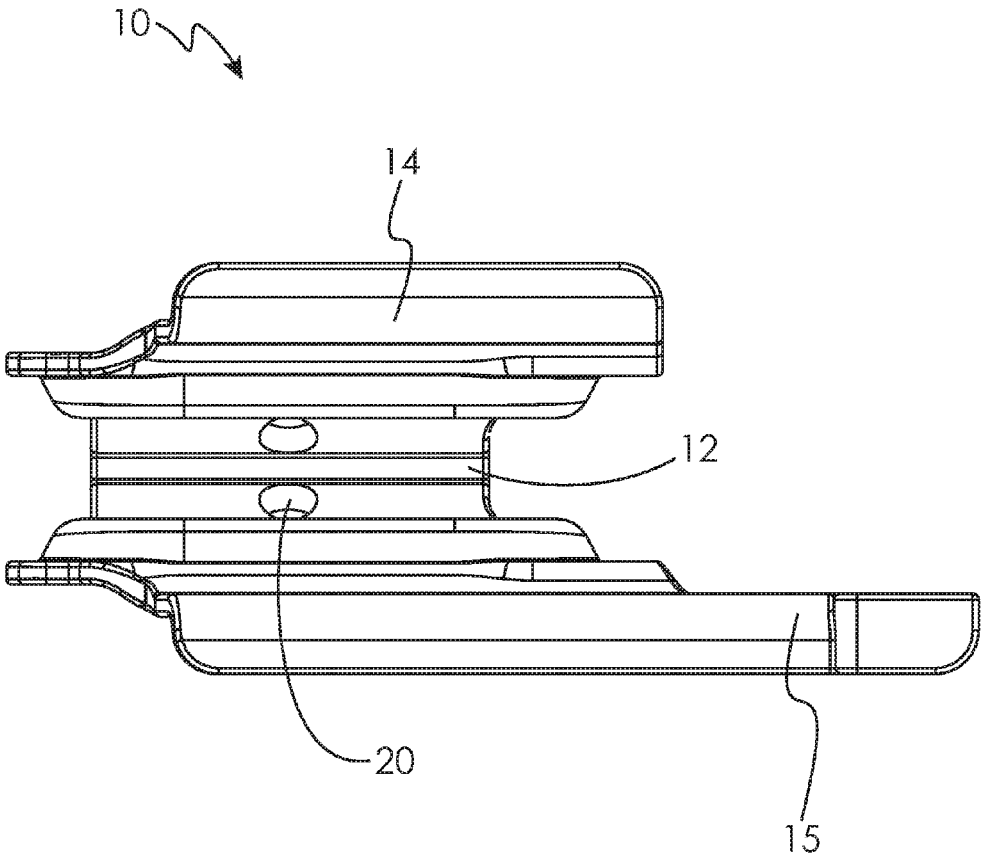
FIG. 4 is a top perspective view of a trigger guard safety device in accordance with an embodiment.
Figure 5:
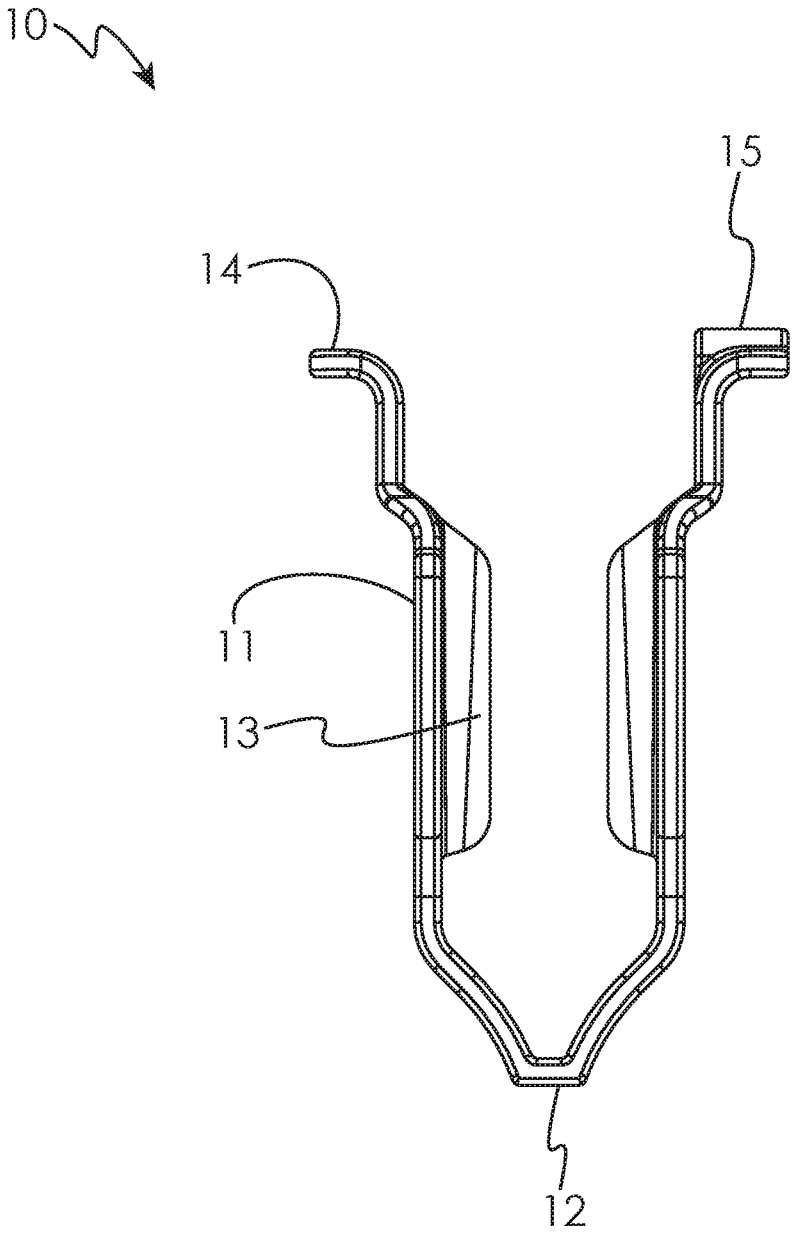
FIG. 5 is a front perspective view of a trigger guard safety device in accordance with an embodiment.

In FIGS. 1-5, an embodiment of a trigger guard safety device 10 is shown. The trigger guard safety device 10 comprises sides 11, bottom 12, depressions 13, and flanges 14. In one embodiment, the trigger guard safety device 10 can be formed from a plastic material such as Kydex® resinous material that is moldable when heated and then hardens to a rigid but semiflexible material. It should be understood by one of skill in the art that others materials can be used to make the trigger guard safety device 10.

The rigid but semiflexible nature of the trigger guard safety device 10 allows the sides 11 to flex around the trigger guard of a weapon when securing the trigger guard safety device 10 in place. The rigid but semiflexible nature of the trigger guard safety device 10 causes the sides 11 to snap back to their original configuration after positioning of the trigger guard safety device 10 around the trigger guard of a weapon. In some embodiments, the bottom 12 of the trigger guard safety device 10 rests under the trigger guard and fits snuggly against the trigger guard.

The trigger guard safety device 10 may be molded to the configuration of the trigger guard of a weapon such that when the trigger guard safety device 10 is placed on the trigger guard, the depressions 13 of sides 11 fit inside the cavity created by the trigger guard. Sides 11 snap in place around the trigger guard of a weapon, and the rigid but semiflexible nature of sides 11 and depressions 13 act to secure the trigger guard safety device 10 in place. The sides 11 and depressions 13 of the trigger guard safety device 10 physically prevent access to and depression of the trigger to avoid unintended discharge of the weapon.

The flanges 14 of the trigger guard safety device 10 may be located in some embodiments at the end of sides 11 of the u-shaped trigger guard safety device 10 such that when the trigger guard safety device 10 is secured in place the flanges 14 extend from substantially 30 degrees to substantially 90 degrees from the weapon at a location above the trigger and trigger guard. The flanges 14 may also include an extended portion 15 that extends longitudinally from the flanges 14 behind the trigger guard in the opposite direction of the barrel of the weapon. The flanges 14 aid in removal of the trigger guard safety device 10 to allow for quick discharge of the weapon.

With reference to FIGS. 1-4, one embodiment of the trigger guard safety device 10 comprises at least one hole 20. The at least one hole 20 allows for the attachment of a lanyard to the trigger guard safety device 10 through the at least one hole 20. The opposite end of the lanyard may then be secured to another object such that when the weapon is grabbed from its storage location the trigger guard safety device 10 is quickly and automatically removed from the weapon by the action of the lanyard. It should be understood by one of skill in the art that other tethers may be used in place of the lanyard. In other embodiments, the opposite end of the lanyard may be secured to the weapon instead of another object. In such embodiments, the lanyard does not automatically remove the trigger guard safety device 10, but merely retains the trigger guard safety device 10 with the weapon after the trigger guard safety device 10 is removed.

The embodiments described herein provide a streamlined trigger guard safety device for avoiding unintended discharges of a loaded weapon while allowing for easy transport and rapid discharge, when necessary. The embodiments described herein provide an easy to operate and unobtrusive trigger guard safety device for securing the trigger of a weapon without requiring additional special storage or safety devices. Furthermore, the embodiments described herein provide a trigger guard safety device of simple construction with minimal obstructions to impede quickly drawing and discharging a loaded weapon. In particular, many embodiments of the trigger guard safety device exhibit a perimeter that is smooth and without protrusions that could catch on clothing or holsters, which would thereby impede the rapid removal of the weapon from such clothing or holster.

While the embodiments have been illustrated and described in detail in the drawings and foregoing description, the same is to be considered as illustrative and not restrictive in character, it being understood that only certain embodiments have been shown and described and that all changes and modifications that come within the spirit of the embodiments are desired to be protected.

The invention claimed is:

1. A method for avoiding an unintended discharge of a loaded weapon while providing for quickly drawing and discharging the weapon, comprising the steps of:

providing a trigger guard safety device, the trigger guard safety device comprising:

a first side having a first flange and a first depression, a second side having a second flange and a second depression, and a bottom joining the first side and the second side, wherein the trigger guard safety device has a construction allowing the first side to move away from the second side upon the application of a separating force thereto;

releasably securing the trigger guard safety device around a trigger guard of a weapon, wherein the first depression and second depression are constructed and arranged to extend into a cavity created by the trigger guard of the weapon when installed thereon to physically prevent access to and depression of a trigger;

securing a tether to the trigger guard safety device, the tether comprising a first end and a second end;

drawing the weapon, and removing the trigger guard safety device when sufficient tension applied to the trigger guard safety device by the tether prevents the trigger guard safety device from moving with the weapon as the weapon is drawn.

2. The method of claim 1, wherein the step of securing the tether includes attaching the first end of the tether to the trigger guard safety device and attaching the second end of the tether to another object.

3. The method of claim 1, wherein the step of securing the tether includes attaching the first end of the tether to the trigger guard safety device and attaching the second end of the tether to a person holding the weapon.

4. The method of claim 1, wherein the step of securing the tether includes attaching the first end of the tether to the trigger guard safety device and attaching the second end of the tether to the weapon.

* * * * *